US011109687B1

(12) United States Patent
Cook

(10) Patent No.: US 11,109,687 B1
(45) Date of Patent: Sep. 7, 2021

(54) CONFIGURABLE ERGONOMIC PAD

(71) Applicant: THE BOEING COMPANY, Chicago, IL (US)

(72) Inventor: Rebecca Cook, North Charleston, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/790,403

(22) Filed: Feb. 13, 2020

(51) Int. Cl.

| | |
|---|---|
| ***A47C 27/08*** | (2006.01) |
| ***A47C 27/10*** | (2006.01) |
| ***A61G 7/057*** | (2006.01) |
| ***A47C 9/02*** | (2006.01) |
| ***A47C 31/10*** | (2006.01) |

(52) U.S. Cl.
CPC ..... *A47C 27/086* (2013.01); *A47C 9/02* (2013.01); *A47C 27/083* (2013.01); *A47C 27/10* (2013.01); *A47C 31/10* (2013.01); *A61G 7/05738* (2013.01); *A61G 7/05753* (2013.01)

(58) Field of Classification Search
CPC ..... A47C 27/086; A47C 27/083; A47C 27/08; A47C 27/10; A61G 7/05738; A61G 7/05753; Y10S 5/911; Y10S 5/913; Y10S 5/91; Y10S 5/925; Y10S 5/926
USPC ..... 5/655.4, 702, 911, 913, 910, 925, 926
See application file for complete search history.

(56) References Cited

U.S. PATENT DOCUMENTS 3,017,642 A 1/1962 David et al.
3,608,961 A * 9/1971 Von Heck ..... A47C 7/02 297/284.1
3,745,998 A * 7/1973 Rose ..... A61F 5/05833 602/6
4,045,830 A * 9/1977 Loeb ..... A61G 1/00 5/81.1 T
4,234,982 A * 11/1980 Bez ..... A61G 7/05753 5/702
4,327,046 A * 4/1982 Davis ..... A47C 27/086 264/102
4,347,213 A * 8/1982 Rogers, Jr. ..... A61F 5/01 264/510
4,388,358 A * 6/1983 Davis ..... A47C 27/086 428/304.4
4,457,032 A * 7/1984 Clarke ..... B60N 2/60 297/219.1
(Continued)

FOREIGN PATENT DOCUMENTS

DE 2018332982 A1 12/2017
WO 2007128967 A2 11/2007

OTHER PUBLICATIONS

Brown et al., "Universal Robotic Gripper Based on the Jamming of Granular Material", PNAS, vol. 107, No. 44, Nov. 2, 2010, pp. 18809-18814, www.pnas.org/cgi/doi/10.1073/pnas.1003250107.
(Continued)

*Primary Examiner* — Robert G Santos
(74) *Attorney, Agent, or Firm* — Moore Intellectual Property Law, PLLC

(57) ABSTRACT

An ergonomic pad includes a bladder formed of a pliable material and a granular material disposed within the bladder and at least partially filling the bladder. A port is coupled to the bladder and configured to enable evacuation of air from the bladder. The bladder also includes a sealable opening distinct from the port to add or remove the granular material.

23 Claims, 8 Drawing Sheets

(56) References Cited

U.S. PATENT DOCUMENTS

| | | | | |
|---|---|---|---|---|
| 5,111,544 | A * | 5/1992 | Graebe | A47C 7/021 5/654 |
| 4,615,856 | A | 12/1993 | Michael | |
| 6,684,433 | B2 * | 2/2004 | Giori | A47C 27/081 5/709 |
| 6,901,617 | B2 * | 6/2005 | Sprouse, II | A47C 4/54 297/219.1 |
| 8,202,002 | B2 | 6/2012 | McMahon et al. | |
| 8,479,326 | B1 * | 7/2013 | Roberts | A63B 21/4037 5/81.1 HS |
| 9,433,301 | B2 * | 9/2016 | Brechet | A47C 3/16 |
| 2002/0148045 | A1 * | 10/2002 | Giori | A47C 27/088 5/709 |
| 2003/0205920 | A1 * | 11/2003 | Sprouse, II | A47C 7/021 297/219.1 |
| 2004/0172763 | A1 * | 9/2004 | Sachs | A47C 3/16 5/656 |
| 2006/0112489 | A1 | 6/2006 | Bobey et al. | |
| 2015/0250328 | A1 * | 9/2015 | Brechet | A47C 27/086 297/452.41 |
| 2018/0332982 | A1 | 11/2018 | Son et al. | |

OTHER PUBLICATIONS

Extended European Search Report for Application No. 21156087.5 dated Jul. 8, 2021, pp. 1-9.

* cited by examiner

CONFIGURABLE ERGONOMIC PAD

FIELD OF THE DISCLOSURE

The present disclosure is related to ergonomic pads.

BACKGROUND

Manufacturing workers sometimes use support pads to reduce or prevent injuries and to limit or avoid damaging surfaces in a work area. For example, a support pad can be used to enable a worker to position herself in a more ideal position to perform a particular task to prevent ergonomic injury. As another example, a support pad may be used to cover sharp edges or other hazards in the work area.

Because of the wide variety of use cases for such support pads and the variety of body types of users of such support pads, a number of different or custom support pads may be maintained. It is expensive to acquire and maintain such a variety of support pads. Additionally, the support pads take up a great deal of storage space.

Furthermore, when a large selection of custom support pads are maintained and a user is performing multiple different tasks at a work area, the user may need to either transport several different support pads to the work area or make compromises by using available support pads that are not well suited for a particular task or user.

SUMMARY

An ergonomic pad (along with related systems and methods) is disclosed. The ergonomic pad can be customized for a particular user and work area, which reduces the need to acquire and maintain a large selection of support pads.

According to a particular aspect, an ergonomic pad includes a bladder formed of a pliable material and a granular material disposed within the bladder and at least partially filling the bladder. A port is coupled to the bladder and configured to enable evacuation of air from the bladder. The bladder also includes a sealable opening distinct from the port to add or remove the granular material.

According to another particular aspect, an ergonomic pad system include a first ergonomic pad and a second ergonomic pad. The first ergonomic pad includes a first bladder and a first quantity of a packing material disposed within the first bladder. The packing material has a void fraction greater than 0.35. A first port is coupled to the first bladder and configured to enable evacuation of air from the first bladder. The first ergonomic pad also includes a first connector coupled to the first port. The second ergonomic pad includes a second bladder and a second quantity of the packing material disposed within the second bladder. A second port is coupled to the second bladder and configured to enable evacuation of air from the second bladder. The second ergonomic pad also includes a second connector coupled to the second port. The second connector is configured to couple to the first connector to link the first bladder and the second bladder.

According to another particular aspect, a method includes positioning a bladder of an ergonomic pad with respect to surfaces in a work area. Positioning the bladder with respect to the surfaces causes a material disposed in the bladder to settle into a position conformed to the surfaces. The method also includes activating a vacuum source that is in fluid communication with a port of the ergonomic pad to extract air from the bladder to cause the bladder to conform to the material such that sides of the ergonomic pad take on shapes complementary to the surfaces.

The features, functions, and advantages described herein can be achieved independently in various implementations or may be combined in yet other implementations, further details of which can be found with reference to the following description and drawings.

DETAILED DESCRIPTION

Figure 1:
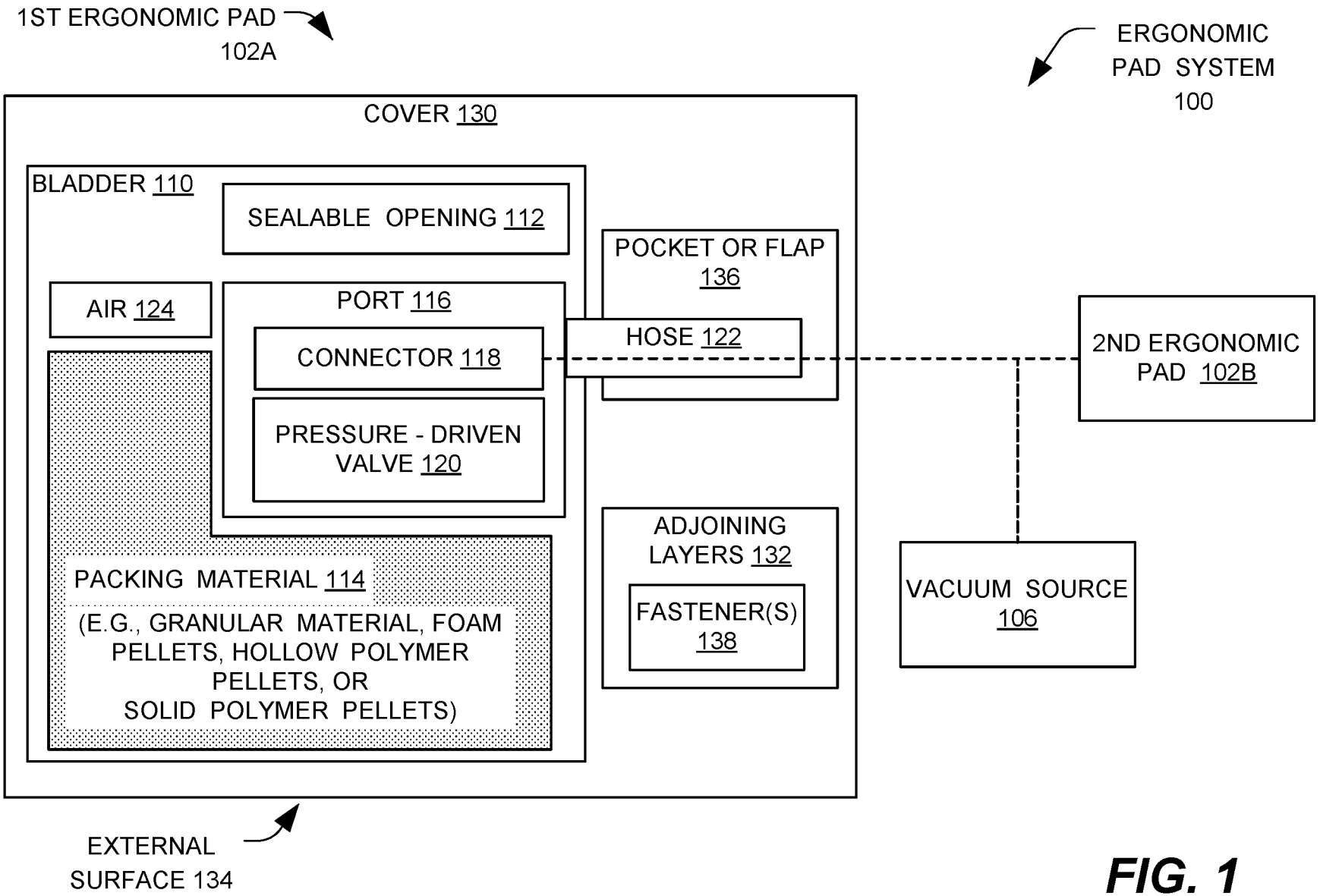
FIG. 1 is a block diagram illustrating an ergonomic pad system including multiple ergonomic pads in accordance with one implementation.

The figures and the following description illustrate specific exemplary implementations. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

Particular implementations are described herein with reference to the drawings. In the description, common features are designated by common reference numbers throughout the drawings. In some drawings, multiple instances of a particular type of feature are used. Although these features are physically and/or logically distinct, the same reference number is used for each, and the different instances are distinguished by addition of a letter to the reference number. When the features as a group or a type are referred to herein (e.g., when no particular one of the features is being referenced), the reference number is used without a distinguishing letter. However, when one particular feature of multiple features of the same type is referred to herein, the reference number is used with the distinguishing letter. For example, referring to FIG. 1, multiple ergonomic pads are illustrated and associated with reference numbers 102A and 102B. When referring to a particular one of these ergonomic pads, such as the ergonomic pads 102A, the distinguishing letter "A" is used. However, when referring to any arbitrary one of these ergonomic pads or to these ergonomic pads as a group, the reference number 102 is used without a distinguishing letter.

The terminology used herein should be accorded its usual and customary meaning within the relevant technical area unless context clearly indicates otherwise. Following are examples of definitions of some of the terms used herein.

The singular articles "a," "an," and "the" are intended to include the plural forms as well, unless the context clearly indicates otherwise. Further, some features described herein are singular in some implementations and plural in other implementations. For ease of reference herein, such features may be introduced as "one or more" features and may be subsequently referred to in the singular unless aspects related to multiple of the features are being described.

The terms "comprise," "comprises," and "comprising" are used interchangeably with "include," "includes," or "including." Additionally, the term "wherein" is used interchangeably with the term "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

As used herein, "coupled" can include "communicatively coupled," "electrically coupled," or "physically coupled," and can also (or alternatively) include any combinations thereof. Two devices (or components) can be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled can be included in the same device or in different devices and can be connected via electronics, one or more connectors, or inductive coupling, as illustrative, non-limiting examples. In some implementations, two devices (or components) that are communicatively coupled, such as in electrical communication, can send and receive electrical signals (digital signals or analog signals) directly or indirectly, such as via one or more wires, buses, networks, etc. As used herein, "directly coupled" is used to describe two devices that are coupled (e.g., communicatively coupled, electrically coupled, or physically coupled) without intervening components.

The term "packing material" refers to a set of individual objects that collectively interact with one another (e.g., pack together) in a manner that allows fluid-like motion when loosely packed and solid-like behavior when closely packed. "Fluid-like" and "solid-like" in this context refer to bulk properties of the packing material rather than to a properties of individual particles of the packing material.

An ergonomic pad according to the present disclosure is filled with a material (e.g., a packing material) that enables reconfiguration of a shape of the ergonomic pad in some circumstances and retains the shape of the ergonomic pad in other circumstances. To illustrate, a user can extract air from the ergonomic pad to customize the shape of the ergonomic pad to the particular user and use case. In some implementations, the quantity of the material in the ergonomic pad can also be adjusted prior to use. For example, a user working in a more confined work area may use an ergonomic pad with a relatively small quantity of the material as compared to a user working in a wide open or less confined work area.

In addition to providing significant customization, the ergonomic pad may use less storage space. For example, the ergonomic pad can be disassembled into easily storable components. To illustrate, the ergonomic pad can include a bladder that is at least partially filled with the material for use. When not in use, the bladder and the material can be stored separately. Generally, the material is a packing material that can be compacted for storage. However, even if a non-compactable material is used, storing the bladders and the material separately uses less storage space than storing a comparable variety of custom support pads, including support pads of various size and shapes that can take up a large amount of storage space.

Additionally, a single ergonomic pad can be used for a wide variety of work situations because the ergonomic pad can be shaped to various and different work surfaces at a large number of work areas.

To illustrate, a user can position an ergonomic pad in the location in which it will be used. The user positions herself on the ergonomic pad in a desired work position and causes air to be extract from the ergonomic pad. Removing air from the ergonomic pad causes the ergonomic pad to conform to the shape of nearby surfaces, such as contours of the work area, contours of the user's body (e.g., the body shape, size or the shape and size of specific body parts), or both. The ergonomic pad is configured to maintain the shape until the user reintroduces air into the ergonomic pad, at which point the ergonomic pad is pliable or conformable and ready for reuse at another work area or by another user.

When air has been evacuated from the ergonomic pad, the ergonomic pad is relatively stiff, and the more air that is removed, the stiffer the ergonomic pad becomes. When the ergonomic pads is relatively stiff, it retains the shape to which it is conformed (e.g., a shape of the underlying surface, a shape of surrounding surfaces, a shape of a body part of the user, etc.). The user can adjust the stiffness of the ergonomic pad for a particular use case. To illustrate, the user can remove more air (to make the ergonomic pad stiffer) in order to cover a protrusion in a surface of the work area, to level the work area, etc. However, in another situation, the user can leave the ergonomic pad less stiff in order to provide more comfortable (e.g., softer) support for the user. When air is reintroduced into the ergonomic pad, the ergonomic pad becomes reconfigurable again. For example, the ergonomic pad ceases to retain the shape of adjacent surfaces.

FIG. 1 is a block diagram illustrating an ergonomic pad system 100 including multiple ergonomic pads 102 in accordance with one implementation. In FIG. 1, the ergonomic pad system 100 includes a first ergonomic pad 102A and a second ergonomic pad 102B. Each of the ergonomic pads 102 includes a bladder 110, a packing material 114 disposed within the bladder 110, and one or more ports, such as a port 116, that enables evacuation of air 124 from the bladder 110. The bladder 110 is formed of or comprises a pliable material to enable the bladder 110 to take on a variety of shapes, such as a shape that is complementary to a surface on which the ergonomic pad 102 is placed.

The packing material 114 at least partially fills the interior of the bladder 110. Examples of packing materials include a granular materials, such as solid polymer pellets, hollow polymer pellets, or foam pellets. Other packing materials can be used in different implementations. For example, a company or user may use renewable packing material 114 (such as chopped straw) in situations where the packing material 114 is not expected to be reused many times (e.g., if the packing material 114 may be damaged or fouled by the work environment). The packing material 114 should have void spaces between particles of the packing material 114 such that the packing material 114 is able to shift to change shapes and such that extracting the air 124 from the bladder 110 can retain the packing material 114 is a particular shape. As an example, in some implementations, the packing material 114 has a void fraction greater than 0.35.

In the example illustrated in FIG. 1, the bladder 110 includes a sealable opening 112 (distinct from the port 116) to enable a user to add more packing material 114 to the bladder 110 or to remove some or all of the packing material 114 from the bladder 110. In this example, the sealable opening 112 further increase flexibility and customizability of the ergonomic pad 102. For example, a smaller user can add packing material 114 to the ergonomic pad 102 to attain a more comfortable work position. As another example, a user working in a relative confined area can remove some of the packing material 114 from the ergonomic pad 102 to make it easier to position the ergonomic pad 102 in the work area. Additionally, much or all of the packing material 114 can be removed from the ergonomic pad 102 to facilitate storage.

When the sealable opening 112 and the port 116 are closed, the bladder 110 is substantially airtight. In this context, "airtight" means that air passes into or out of the bladder 110 at a negligible rate in view of the typical time scales of use of the ergonomic pad 102. For example, the ergonomic pad 102 is intended for use by a worker, and such workers typically work shifts of eight hours or less and take breaks during the shift. As a result, in this example, the ergonomic pad 102 should sufficiently airtight to maintain its shape for a period between two breaks, e.g., about two hours. It is understood that in different contexts, other criteria for whether the ergonomic pad 102 is sufficiently airtight can be used. Further, it is understood that the ergonomic pad 102 may become less airtight over time, due to wear on seals, damage to the bladder 110, etc.

The port 116 passes through the bladder 110 and includes a valve which limits airflow when in a closed position and allows airflow when in an open position. In the example illustrated in FIG. 1, the valve is a pressure-drive valve 120, such as a diaphragm valve. In this example, the valve is configured to open automatically responsive to a large pressure differential in which the pressure inside the bladder 110 is larger than the pressure outside the port 116. To illustrate, when a vacuum source 106 is coupled to the port 116 and activated, the vacuum source 106 reduces pressure outside the valve, which can cause the valve to open to allow a portion of the air 124 to pass through the port 116. The valve seals when the pressure differential is such that the pressure inside the bladder 110 is less than the pressure outside the port 116. For example, after a portion of the air 124 has been removed by the vacuum source 106, pressure inside the bladder 110 may be less than ambient air pressure. In this example, the pressure differential seals the valve to maintain the pressure differential, which in turn retains the ergonomic pad 102 in a particular shape. The valve enables the bladder 110 to conform to a shape that is at least partially defined by the packing material 114 after air 124 is extracted from the bladder 110 and the port 116 is disconnected from a vacuum source 106 or the vacuum source 106 is deactivated. Thus, the vacuum source 106 is not needed continuously during use of the ergonomic pad 102. In some implementations, the valve is manually openable to enable equalization of the pressure level in the bladder 110 with an ambient pressure level. For example, the valve may include a button, switch, or knob that can be manually actuated to open the valve.

The port 116 is configured to removably couple to the vacuum source 106. For example, the port 116 can include or be coupled to a connector 118 that is configured to couple to the vacuum source 106, to another ergonomic pad 102B, or both, as described further below. In some implementations, a flexible hose 122 is coupled to the port 116, and the connector 118 is coupled to the hose 122. For example, in FIG. 1, the ergonomic pad 102 includes a cover 130 over the bladder 110. In such implementations, the hose 122 can be stored in the cover 130 (e.g., in a pocket or flap 136) to protect the hose 122 when it is not in use. The hose 122 can be extended through the cover 130 when air 124 is to be added to or removed from the bladder 110. In some implementations, the hose 122 also enables a user to access the port 116 (e.g., to add or remove air 124) irrespective of a position and orientation of the ergonomic pad 102. For example, the hose 122 can be extended to enable a user to remove air 124 from the bladder 110 even if the ergonomic pad 102 is positioned such that the port 116 is below the bladder 110 (e.g., not directly accessible to the user).

In FIG. 1, the cover 130 includes a plurality of adjoining layers 132, such as a first layer and a second layer that adjoin or abut one another to define an external surface 134 of the ergonomic pad 102. For example, a first layer of the adjoining layers 132 can form the external surface 134 on a first side of the ergonomic pad 102, and a second layer of the adjoining layers 132 can form the external surface 134 on a second side (e.g., the opposite side) of the ergonomic pad 102. To illustrate, when the first layer is atop the bladder 110, the second layer may be disposed beneath the bladder 110.

In some implementations, the adjoining layers 132 are formed of different materials or have different structures. To illustrate, in some implementations, the first layer has a first surface texture (e.g., a smoother texture) and the second layer has a second surface texture (e.g., a rougher texture). In such implementations, the second surface may be more durable or have a higher coefficient of friction, and as such, may be positioned in contact with a work surface to reduce slippage and damage to the ergonomic pad 102. In contrast, the first surface is more comfortable and therefore may be positioned to contact the user. In some implementations, the first layer has a first surface tackiness and the second layer has a second surface tackiness, where the first surface tackiness is more adhesive than the second surface tackiness. In such implementations, the second surface may reduce slippage, and as such, may be positioned in contact with a work surface; whereas, the first surface is more comfortable and may be positioned to contact the user.

In FIG. 1, the one or more of the adjoining layers 132 includes one or more fasteners 138. The fasteners 138 include, for example, hook and loop fasteners, hook and eye fasteners, snaps, buckles, belts, other types of fasteners configured to enable one ergonomic pad 102 to be fastened to another ergonomic pad 102 or configured to enable an ergonomic pad 102 to be fastened to a work surface. In a particular implementation, the fasteners 138 consist of any number of fasteners such as one to twenty fasteners, or one to eight fasteners, or two to four fasteners.

In FIG. 1, the bladder 110 is at least partially enclosed by the cover 130. In some implementations, the cover 130 is removable. For example, the cover 130 can be formed of a washable material (e.g., one or more durable fabrics or polymers), and the cover 130 can be removed from the bladder 110 for cleaning. In some implementations, the bladder 110 is used without the cover 130 (e.g., the cover 130 is omitted). For example, the bladder 110 can include the adjoining layers 132, the fasteners 138, the pocket or flap 136, or any combination thereof.

In some implementations, each ergonomic pad 102 is configured to interact with or be used with one or more additional ergonomic pads 102. For example, in FIG. 1, the ergonomic pad system 100 includes the first ergonomic pad 102A and the second ergonomic pad 102B, and the vacuum source 106 is coupled to both the first ergonomic pad 102A and the second ergonomic pad 102B. In other examples, the ergonomic pad system 100 includes more than two ergonomic pads 102. When used together, two or more ergonomic pads 102 can be coupled in fluid communication (e.g., a port 116 of one ergonomic pad 102 can be coupled to a port 116 of another ergonomic pad 102) to enable air 124 to be extracted concurrently or simultaneously from the ergonomic pads 102. Additionally, or in the alternative, the two or more ergonomic pad 102 can be physically coupled (or fastened) together. For example, the fasteners 138 of one ergonomic pad 102 can be coupled to the fasteners 138 of the other ergonomic pad 102 for form a physical unit.

Figure 2:
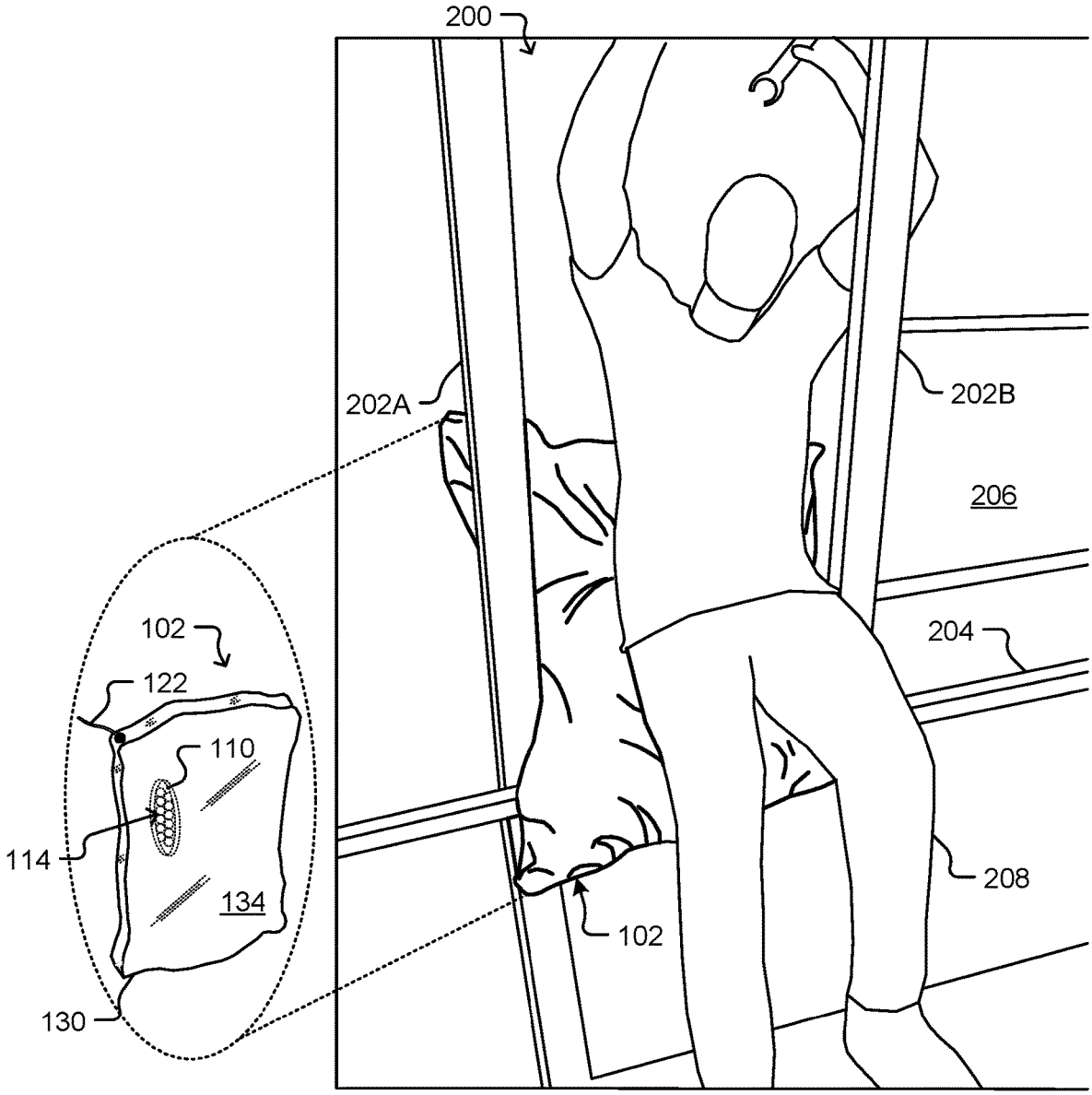
FIG. 2 illustrates using the ergonomic pad system of FIG. 1 in a work area in accordance with one implementation.

FIG. 2 illustrates using the ergonomic pad system 100 of FIG. 1 in a work area 200 in accordance with one implementation. In FIG. 2, the work area 200 includes several surfaces and objects that limit the area in which a user 208 can work. For example, in FIG. 2, the work area 200 is limited by ribs 202A, 202B, stringers 204, and a wall 206 (e.g., a skin coupled to the ribs 202, the stringers 204, or both). In addition to limiting the space in which the user 208 can work, the ribs 202A, 202B, the stringers 204, and the wall 206 form an uneven surface to support the user 208.

In FIG. 2, the user 208 has positioned the ergonomic pad 102 between the ribs 202A and 202B, over the stringer 204, and abutting the wall 206. Subsequently, the user 208 allowed the packing material 114 inside the bladder 110 to settle into a shape complementary to (or approximately complementary to) the surfaces contacted and extracted air 124 from the ergonomic pad 102. When the air 124 is extracted from the bladder 110, the bladder 110 packs the packing material 114 together to limit movement of the packing material 114 such that the ergonomic pad 102 retains the shape complementary to the surfaces contacted until air 124 is reintroduced to the bladder 110. Additionally, the stiffness and/or softness of the ergonomic pad 102 can be adjusted based on how much air is extracted.

The user 208 can then deactivate (e.g., disconnect, suspend, turn off, terminate, etc.) the vacuum source 106 (shown in FIG. 1) and perform work in the work area 200. For example, the user 208 can lean against or rest on the ergonomic pad 102 while performing the work in order to maintain a more comfortable position than leaning directly against the ribs 202A, 202B, the stringers 204, or the wall 206. In addition to being more comfortable, using the ergonomic pad 102 in the work area 200 reduces the risk of workplace injury by improving the ergonomic positioning of the user 208 while working and reducing the risk of the user slipping or be injured by protrusion from the ribs 202A, 202B, the stringers 204, or the wall 206.

Figure 3:
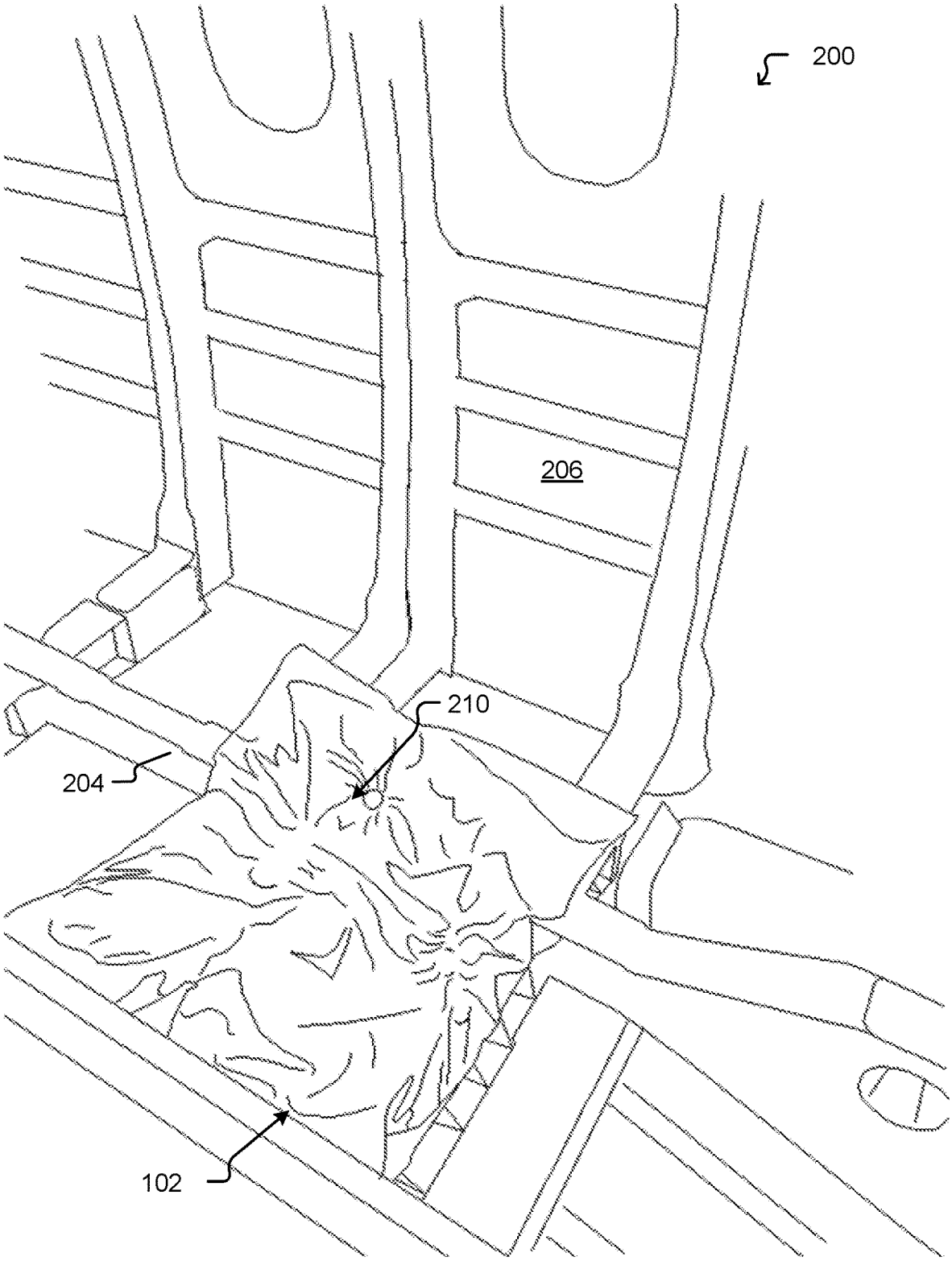
FIG. 3 illustrates another example of using the ergonomic pad system of FIG. 1 in a work area in accordance with one implementation.

FIG. 3 illustrates another example of using the ergonomic pad system 100 in the work area 200. In FIG. 3, a user (e.g., the user 208 of FIG. 2), has conformed the ergonomic pad 102 to one or more surfaces of the work area 200 (such as to the shape of the stringers 204) and to a body part of the user 208 and has extracted air from the ergonomic pad 102 to cause the ergonomic pad 102 to retain its shape. As a result, when the user 208 leaves the work area 200, the ergonomic pad 102 retains its shape. For example, in FIG. 3, the user 208 knelt on the ergonomic pad 102 while removing air from the ergonomic pad 102. Accordingly, the ergonomic pad 102 is shaped to define an indentation 210 corresponding to the user's knees and lower legs. After shaping the ergonomic pad 102, the user 208 left the work area 200, but the ergonomic pad 102 retained the shape established by the user 208 (including the indentation 210 and a shape complementary to the stringers 204).

Figure 4A:
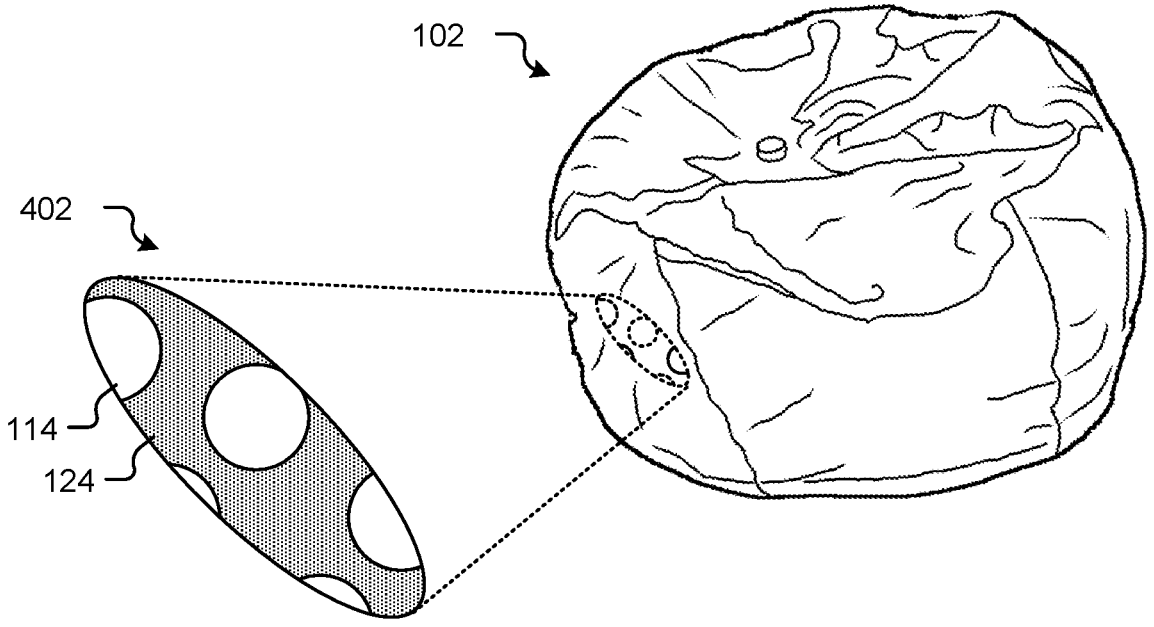
FIG. 4A illustrates the ergonomic pad system of FIG. 1 in a conformable state in accordance with one implementation.
Figure 4B:
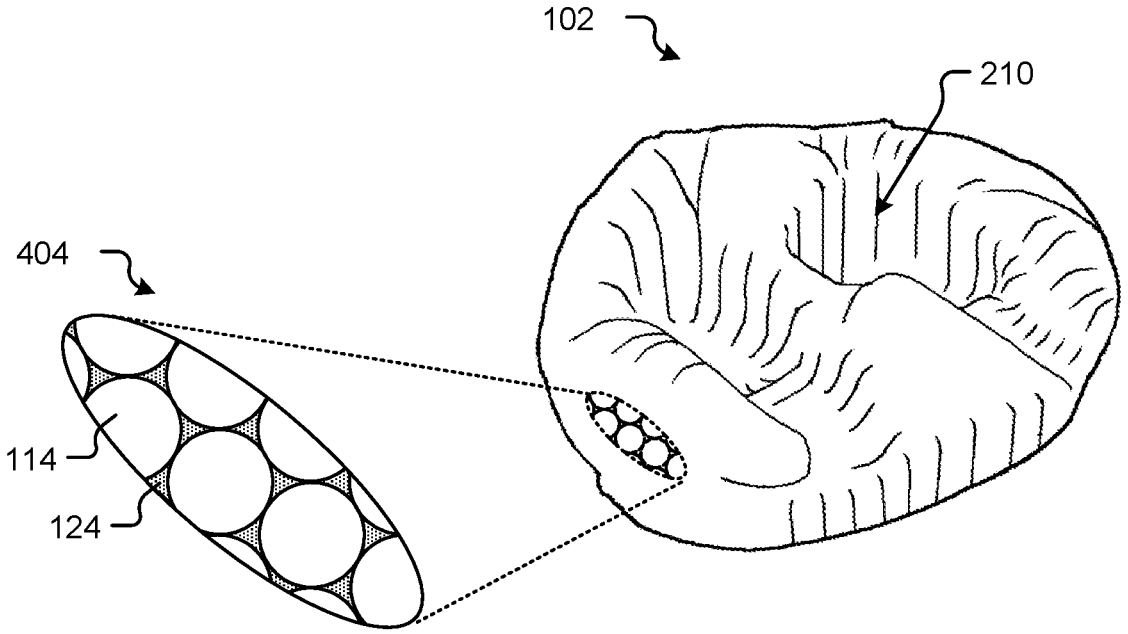
FIG. 4B illustrates the ergonomic pad system of FIG. 1 in a stiff state in accordance with one implementation.

FIGS. 4A and 4B illustrate the ergonomic pad 102 in a conformable state and a stiff state, respectively. As shown in an inset 402 of FIG. 4A, in the conformable state, the packing material 114 is loosely packed (e.g., there is a significant quantity of air intermixed with or in addition to the packing material 114 in the ergonomic pad 102). As a result, in the conformable state, the individual particles of the packing material 114 are free to shift relative to one another, enabling the packing material 114 to have bulk characteristics similar to a fluid (e.g., easily flowing and changing shape). In contrast, as illustrated in an inset 404 of FIG. 4B, in the stiff state, the packing material 114 is tightly packed (e.g., there is a much smaller quantity of air 124 intermixed with or in addition to the packing material 114 in the ergonomic pad 102). As a result, in the stiff state, the individual particles of the packing material 114 are not free to shift relative to one another, causing the packing material 114 to have bulk characteristics similar to a solid (e.g., a tendency to retain its shape).

Figure 5:
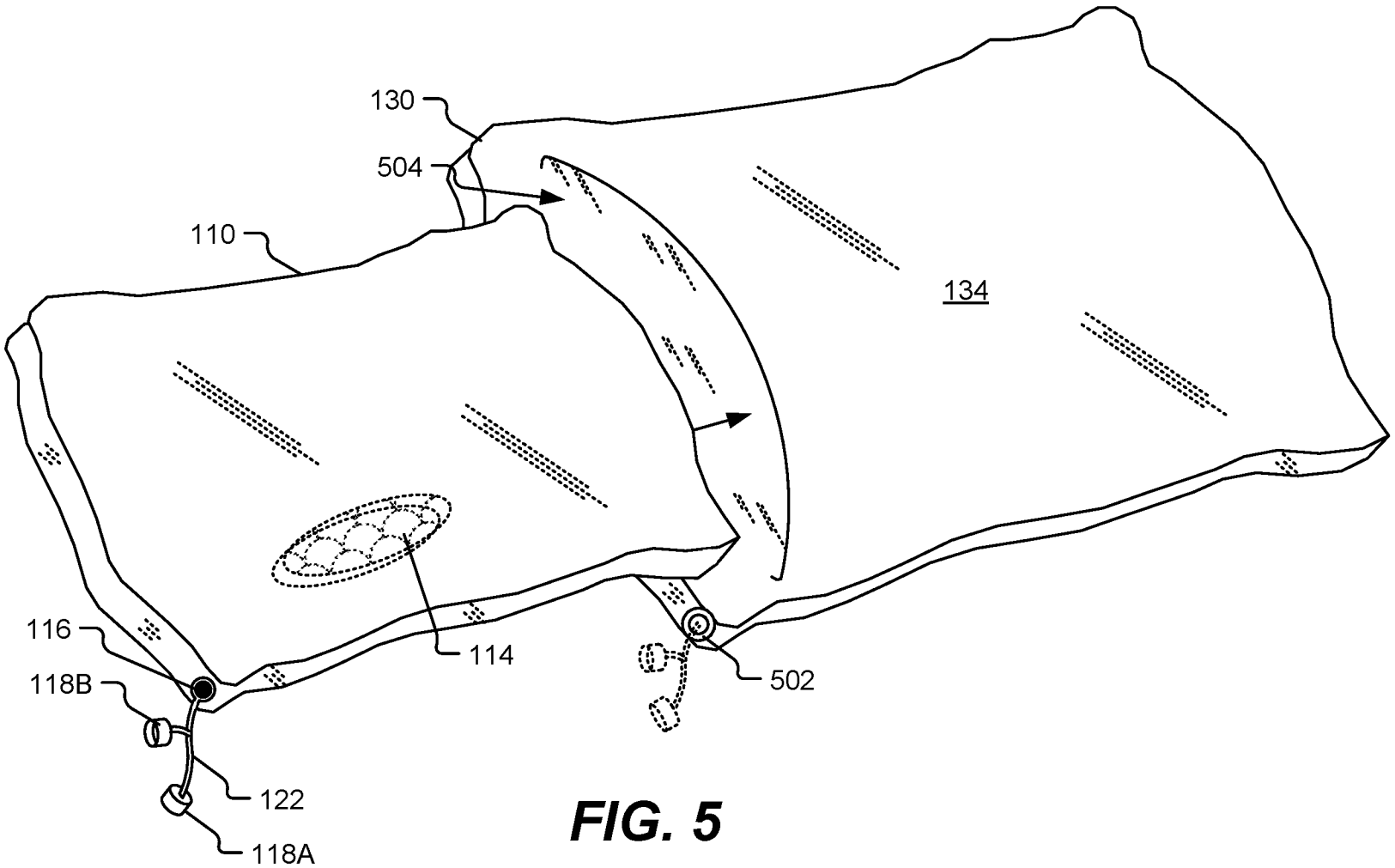
FIG. 5 is a diagram illustrating details of the ergonomic pad system of FIG. 1 in accordance with one implementation.

FIG. 5 is a diagram illustrating details of a particular ergonomic pad 102 of FIG. 1 in accordance with one implementation. FIG. 5 illustrates the cover 130, which in FIG. 5 is a removable cover that defines an opening 504 into which the bladder 110 can be inserted. The cover 130 also defines an opening 502 through which the flexible hose 122 can be extended to enable extraction of air 124 from the bladder 110 while the bladder 110 is enclosed by the cover 130.

FIG. 5 also illustrates a particular implementation in which a port 116 of the ergonomic pad 102 is coupled, via the hose 122, to two or more connectors 118. For example, in FIG. 5, the two connectors 118A and 118B are coupled to the hose 122. This arrangement of the connectors 118 enables connecting multiple ergonomic pads 102 together in a daisy chain manner such that one vacuum source 106 can be used to extract air from the multiple ergonomic pads 102.

Figure 6:
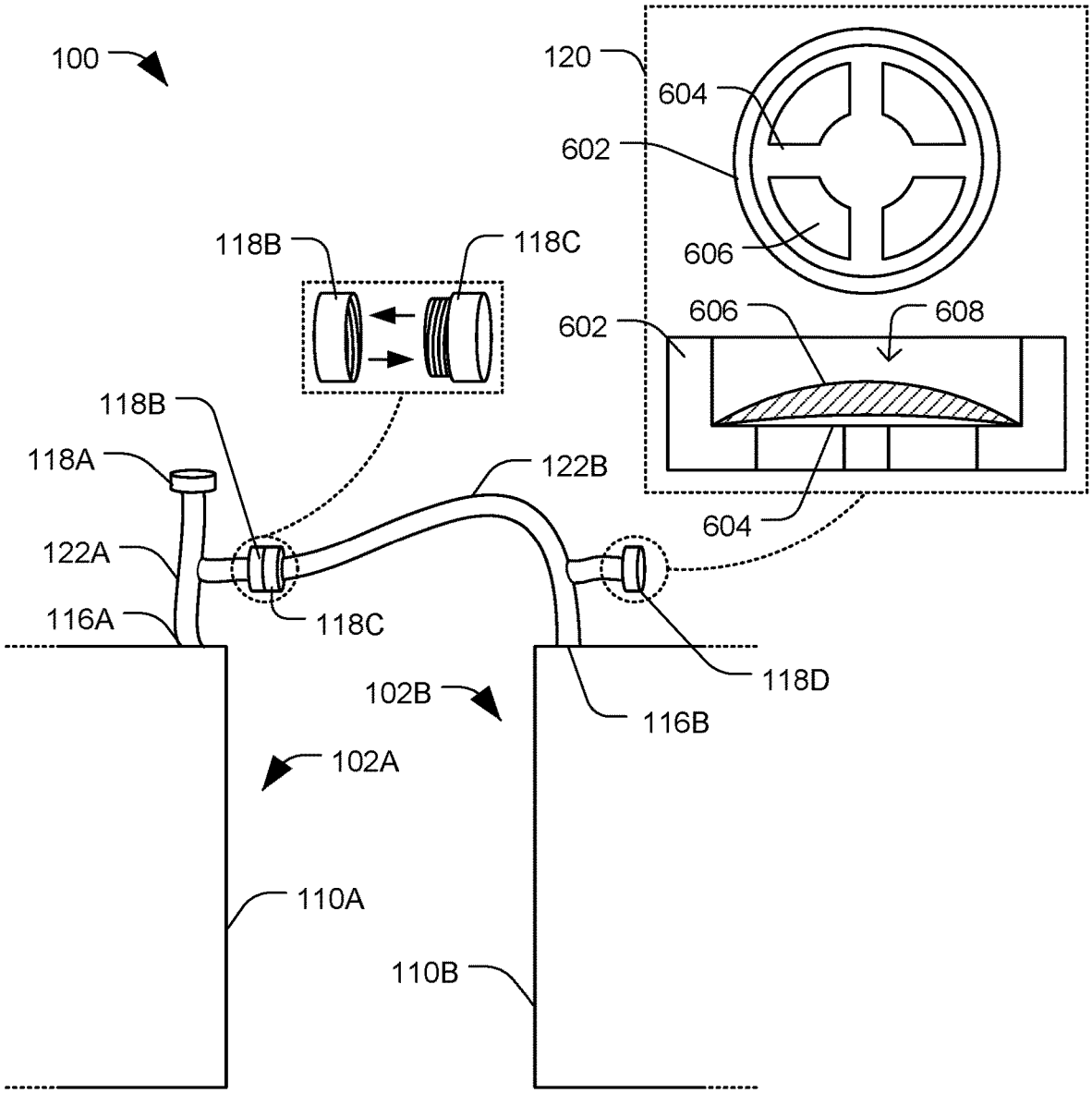
FIG. 6 is a diagram illustrating details of the ergonomic pad system of FIG. 1 in accordance with one implementation.

FIG. 6 is a diagram illustrating details of the ergonomic pad system 100 of FIG. 1 in accordance with one implementation. In particular, FIG. 6 illustrates an example of coupling two or more ergonomic pads 102A, 102B in fluid communication. In FIG. 6, the first ergonomic pads 102A includes a bladder 110A and a port 116A through the bladder 110A. Likewise, a second ergonomic pad 102B includes a second bladder 110B and a second port 116B through the second bladder 110B. The port 116A is coupled to a first hose 122A, which includes a first connector 118A and a second connector 118B. The port 116B is coupled to a second hose 122B, which includes a third connector 118C and a fourth connector 118D. In FIG. 6, each connector 118 includes a valve 120, details of which are illustrated in an inset diagram.

The connectors 118 are configured to mate together to establish fluid communication between the bladders 110. For example, as illustrated in an inset diagram of FIG. 6, the connectors 118 can mate together in threaded pairs, via friction fit, using a clamp and seal arrangement, or some other sealable connection (e.g., a barb). To illustrate, in FIG. 6, the second connector 118B has a female thread pattern and the connector 118C has a corresponding male thread pattern enabling the second and third connectors 118B, 118C to interconnect and form a substantially airtight seal.

The valve 120 illustrated in FIG. 6 is a diaphragm valve that includes a diaphragm 606 coupled to a support structure 604 of a connector housing 602. The diaphragm 606 is positioned such that higher pressure on an external side 608 of the diaphragm 606 causes the diaphragm 606 to seal. Thus, in FIG. 6, the valve 120 is arranged to maintain a lower pressure level inside the bladder than an ambient pressure level.

Figure 7:
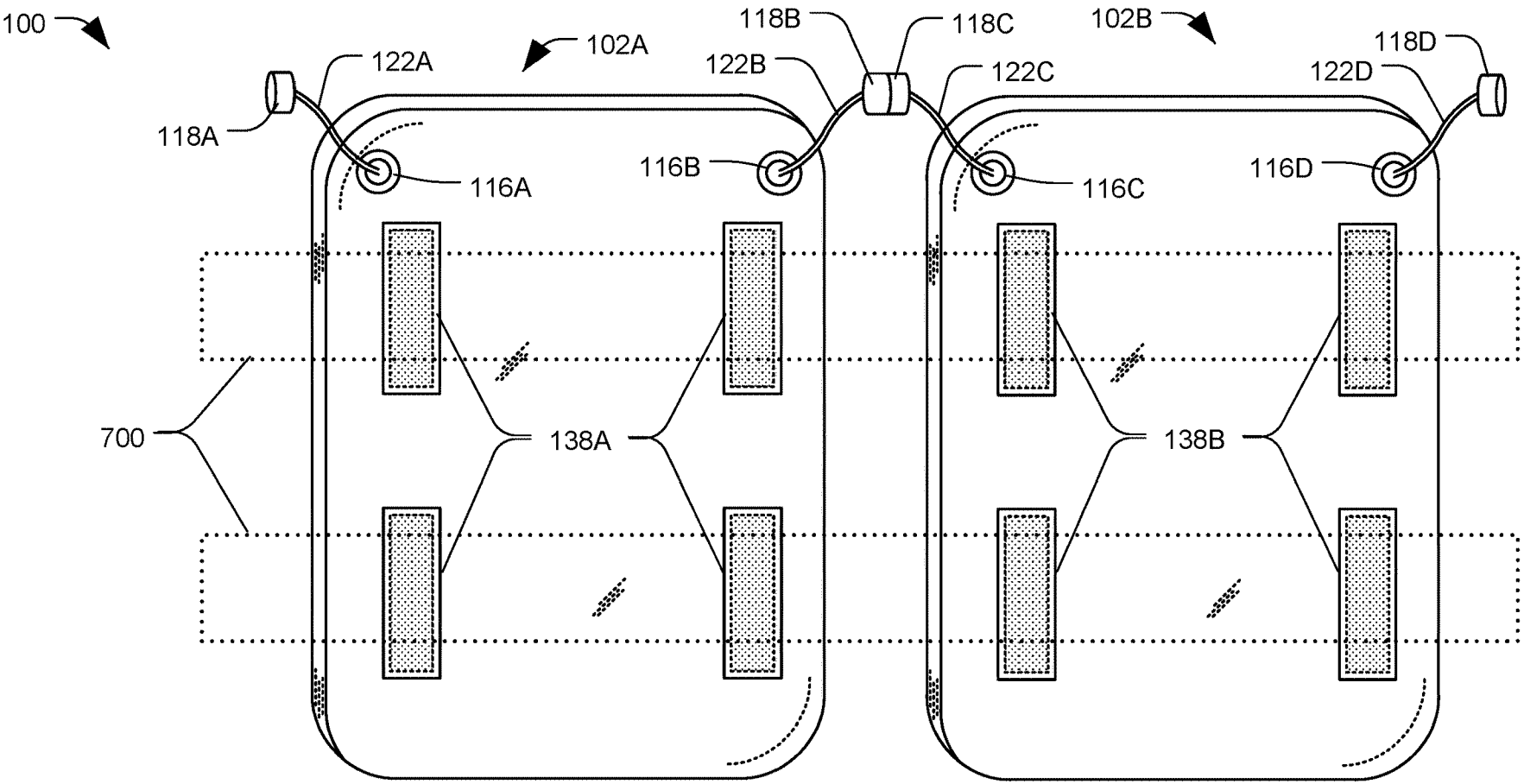
FIG. 7 is a diagram illustrating additional details of the ergonomic pad system of FIG. 1 in accordance with one implementation.

FIG. 7 is a diagram illustrating additional details of the ergonomic pad system of FIG. 1 in accordance with one implementation. In particular, FIG. 7 illustrates another example of coupling two or more ergonomic pads 102A, 102B in fluid communication. In FIG. 7, the first ergonomic pads 102A includes a first port 116A coupled to a first hose 122A and a first connector 118A and includes a second port 116B coupled to a second hose 122B and a second connector 118B. Likewise, the second ergonomic pads 102B includes a third port 116C coupled to a third hose 122C and a third connector 118C and includes a fourth port 116D coupled to a fourth hose 122D and a fourth connector 118D.

As in FIG. 6, the connectors 118 of FIG. 7 are configured to mate together to establish fluid communication between the ergonomic pads 102. For example, in FIG. 7, the second connector 118B is mate to the third connector 118C in threaded pairs.

FIG. 7 also illustrates a particular example of the fasteners 138. In FIG. 7, the first ergonomic pads 102A includes a first plurality of hook and loop strip fasteners 138A, and the second ergonomic pads 102B includes a second plurality of hook and loop strip fasteners 138B. In some implementations, the first plurality of hook and loop strip fasteners 138A are configured to couple to the second plurality of hook and loop strip fasteners 138B. For example, each ergonomic pad 102 can include two hook strips and two loop strips to enable the ergonomic pads 102 to be physically coupled together. Additionally, or in the alternative, the ergonomic pads 102 can be configured to couple together via another fastener. For example, in FIG. 7, two strips 700 are shown connecting the ergonomic pads 102. In this example, the strips 700 can include hook strips that interact with (e.g., attach to) loop strips of the fasteners 138 of the ergonomic pads 102. Alternatively, the strips 700 can include loop strips that interact with (e.g., attach to) hook strips of the fasteners 138 of the ergonomic pads 102. In yet another alternative, one of the strips 700 can be hook strip and the other can be a loop strip, and each strip 700 can interact with a complementary strip of the fasteners 138 of the ergonomic pads 102.

Figure 8:
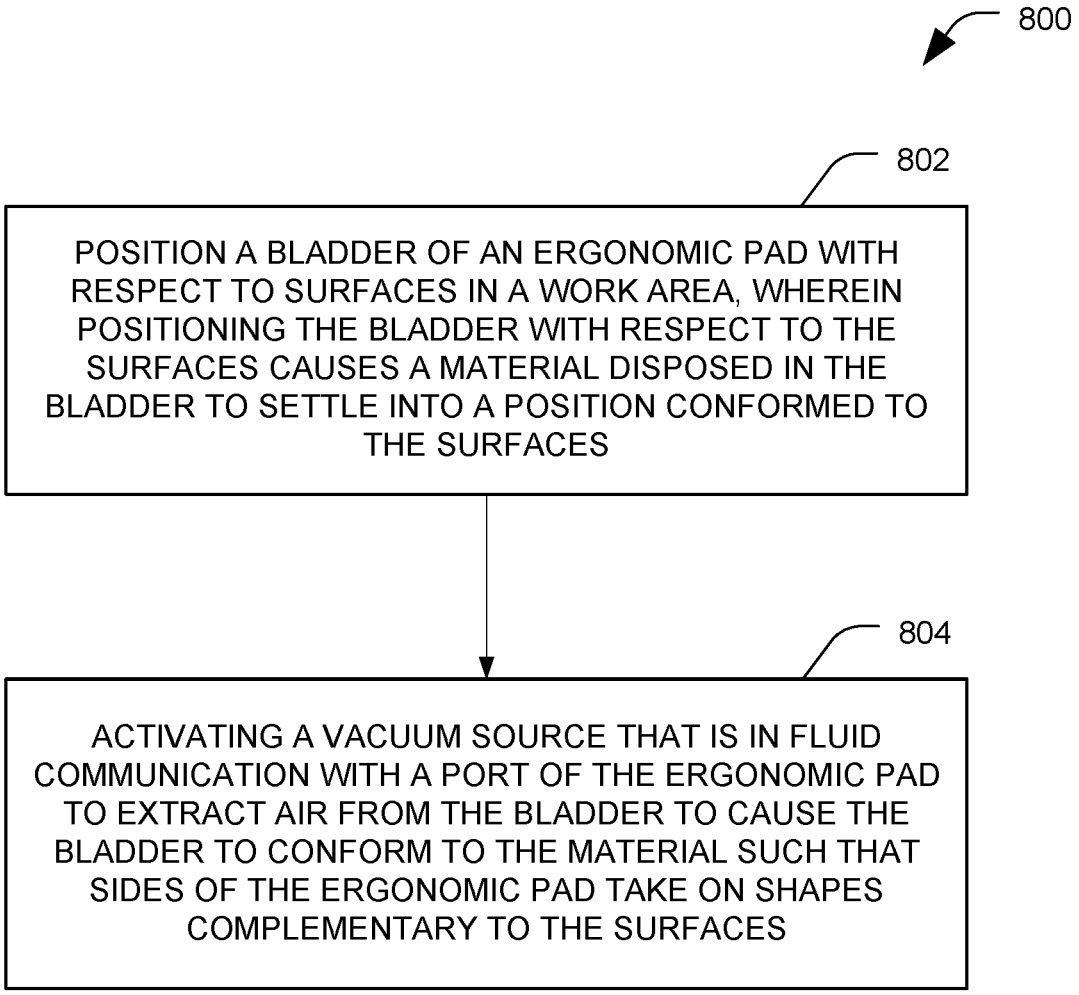
FIG. 8 is a flow chart illustrating a method of using the ergonomic pad system of FIG. 1 in accordance with one implementation.

FIG. 8 is a flow chart illustrating a method 800 of using the ergonomic pad system of FIG. 1 in accordance with one implementation. The method 800 includes, at 802, positioning a bladder of an ergonomic pad with respect to surfaces in a work area. For example, FIG. 2 illustrates the ergonomic pad 102 positioned in the work area 200. Positioning the bladder 110 with respect to the surfaces in the work area 200 causes a material (e.g., the packing material 114) disposed in the bladder 110 to settle into a position conformed to the surfaces.

The method 800 also includes, at 804, activating a vacuum source that is in fluid communication with a port of the ergonomic pad to extract air from the bladder to cause the bladder to conform to the material such that sides of the ergonomic pad take on shapes complementary to the surfaces. For example, after the ergonomic pad 102 is positioned in the work area 200, the vacuum source 106 of FIG. 1 can be activated to extract air 124 from within the bladder 110. Extracting a portion of the air 124 causes the bladder 110 to at least partially conform to the packing material 114. Pressure applied to the packing material 114 by the bladder 110 causes the ergonomic pad 102 to become more rigid and retain a shape at least partially defined by the packing material 114.

In some implementations, the method 800 also includes coupling the port of the ergonomic pad to a second port of a second ergonomic pad before activating the vacuum source. In such implementations, the vacuum source is coupled to a third port of the second ergonomic pad, and air extracted from the bladder passes through the second ergonomic pad responsive to activation of the vacuum source.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate but do not limit the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. An ergonomic pad system comprising:

a first ergonomic pad, the first ergonomic pad comprising:

a first bladder;

a first quantity of a packing material disposed within the first bladder, the packing material having a void fraction greater than 0.35;

a first port coupled to the first bladder, the first port configured to enable evacuation of air from the first bladder; and a first connector coupled to the first port, wherein the first connector comprises a first valve configured to seal responsive to a first pressure differential between the first bladder and a first pressure outside the first valve; and a second ergonomic pad, the second ergonomic pad comprising:

a second bladder;

a second quantity of the packing material disposed within the second bladder;

a second port coupled to the second bladder, the second port configured to enable evacuation of air from the second bladder; and a second connector coupled to the second port, the second connector configured to couple to the first valve to link the first bladder and the second bladder, wherein the second connector comprises a second valve configured to seal responsive to a second pressure differential between the second bladder and a second pressure outside the second valve.

2. The ergonomic pad system of claim 1, wherein the first bladder comprises a sealable opening distinct from the first port to remove the packing material.

3. The ergonomic pad system of claim 2, wherein the sealable opening is further configured to add the packing material.

4. The ergonomic pad system of claim 2, wherein, responsive to the evacuation of air from the first bladder, the first bladder conforms to a shape at least partially defined by the packing material, and wherein the first port and the sealable opening are sufficiently airtight to enable the first bladder to retain the shape after the first port is disconnected from a vacuum source.

5. The ergonomic pad system of claim 1, wherein the first valve is manually openable to enable equalization of a pressure level in the first bladder with an ambient pressure level.

6. The ergonomic pad system of claim 1, wherein the first port is configured to removably couple to a vacuum source to facilitate the evacuation of air from the first bladder.

7. The ergonomic pad system of claim 1, further comprising adjoining layers defining an external surface of the first bladder or of a cover of the first bladder, the adjoining layers including a first layer and a second layer, wherein the first layer and the second layer are disposed on opposite sides of the first bladder such that when the first layer is atop the first bladder, the second layer is beneath the first bladder.

8. The ergonomic pad system of claim 7, wherein the cover is removable.

9. The ergonomic pad system of claim 8, wherein the cover comprises a washable material.

10. The ergonomic pad system of claim 7, wherein at least one of the first layer or the second layer comprises one or more fasteners to fasten more than one ergonomic pad together, the one or more fasteners selected from hook and loop fasteners, hook and eye fasteners, snaps, buckles, or belts.

11. The ergonomic pad system of claim 10, wherein the one or more fasteners consist of one to eight fasteners.

12. The ergonomic pad system of claim 10, wherein the one or more fasteners comprise one to eight hook and loop strips.

13. The ergonomic pad system of claim 7, wherein the first layer has a first surface texture and the second layer has a second surface texture, wherein the first surface texture is smoother than the second surface texture.

14. The ergonomic pad system of claim 7, wherein the first layer has a first surface tackiness and the second layer has a second surface tackiness, wherein the first surface tackiness is more adhesive than the second surface tackiness.

15. The ergonomic pad system of claim 1, further comprising a removable cover at least partially enclosing the first bladder, wherein the first port is accessible through the removable cover.

16. The ergonomic pad system of claim 1, wherein the packing material comprises one or more of: solid polymer pellets, hollow polymer pellets, or foam pellets.

17. The ergonomic pad system of claim 1, further comprising a flexible hose coupled to the first port, the flexible hose comprising the first connector, wherein the first connector is configured to enable coupling the first port to a vacuum source irrespective of a position and orientation of the first bladder.

18. The ergonomic pad system of claim 17, further comprising a pocket or flap configured to retain the flexible hose.

19. The ergonomic pad system of claim 17, further comprising a second flexible hose coupled to the second port, wherein the second flexible hose comprises the second connector, wherein the second connector is configured enable the vacuum source coupled to the first port to evacuate air from the first bladder and the second bladder via the first port.

20. The ergonomic pad system of claim 1, further comprising a hose configured to couple to the first port and to the second port to enable concurrent evacuation of air from the second bladder and the first bladder.

21. The ergonomic pad system of claim 20, further comprising a third port coupled to the second bladder, the third port configured to couple to a vacuum source to extract air from the second bladder and the first bladder.

22. A method comprising:

inserting a granular material into a bladder of an ergonomic pad via a sealable opening;

sealing the sealable opening;

positioning the bladder with respect to surfaces in a work area, wherein positioning the bladder with respect to the surfaces causes the granular material disposed in the bladder to settle into a position conformed to the surfaces;

activating a vacuum source that is in fluid communication with a port of the ergonomic pad to extract air from the bladder to cause the bladder to conform to the granular material such that sides of the ergonomic pad take on shapes complementary to the surfaces; and removing the granular material via the sealable opening.

23. The method of claim 22, further comprising coupling the port of the ergonomic pad to a second port of a second ergonomic pad, wherein the vacuum source is coupled to a third port of the second ergonomic pad, and air extracted from the bladder passes through the second ergonomic pad responsive to activation of the vacuum source.

* * * * *